US007909307B2

(12) United States Patent
Kempf

(10) Patent No.: US 7,909,307 B2
(45) Date of Patent: Mar. 22, 2011

(54) TAB WINCH FOR STAGE USE

(75) Inventor: James Kempf, Wallkill, NY (US)

(73) Assignee: Production Resource Group, LLC, New Windsor, NY (US)

( * ) Notice: Subject to any disclaimer, the term of this patent is extended or adjusted under 35 U.S.C. 154(b) by 0 days.

(21) Appl. No.: 12/483,890

(22) Filed: Jun. 12, 2009

(65) Prior Publication Data

US 2009/0315006 A1 Dec. 24, 2009

Related U.S. Application Data

(60) Provisional application No. 61/061,403, filed on Jun. 13, 2008.

(51) Int. Cl.
*B66D 1/36* (2006.01)

(52) U.S. Cl. ..... 254/286; 254/281; 254/284; 254/285

(58) Field of Classification Search ..... 254/278, 254/280, 281, 284, 285, 286
See application file for complete search history.

(56) References Cited

U.S. PATENT DOCUMENTS

| | | | | |
|---|---|---|---|---|
| 4,438,903 | A * | 3/1984 | Gagnon et al. | 254/269 |
| 4,927,537 | A * | 5/1990 | Meurer | 210/527 |
| 4,928,927 | A * | 5/1990 | Fredrick et al. | 254/279 |
| 4,986,915 | A * | 1/1991 | Meurer | 210/527 |
| 5,511,929 | A * | 4/1996 | Loftus | 414/542 |
| 5,678,805 | A * | 10/1997 | Moser et al. | 254/279 |
| 7,025,334 | B2 * | 4/2006 | Ehrenleitner | 254/278 |
| 7,150,449 | B1 * | 12/2006 | Dueck et al. | 254/278 |
| 7,614,608 | B1 * | 11/2009 | Ebbenga | 254/278 |
| 2005/0200191 | A1 * | 9/2005 | Grier | 298/27 |

* cited by examiner

*Primary Examiner* — Emmanuel M Marcelo
(74) *Attorney, Agent, or Firm* — Law Office of Scott C. Harris, Inc.

(57) ABSTRACT

A winch with adjustable arms allowing the length to be adjusted. The winch can have a very thin drum to allow it to fit in confined spaces.

13 Claims, 4 Drawing Sheets

TAB WINCH FOR STAGE USE

This application claims priority from provisional application Ser. No. 61/061,403, filed Jun. 13, 2008, the entire contents of which are herewith incorporated by reference.

BACKGROUND

Winches can be used to move various objects and scenery, especially in a stage lighting environment. In some applications for a winch, the distances over which force application are carried out can vary.

For example, when lifting scenery on a stage, the width of the scenery depends on the specific scenery being lifted. This width correspondingly sets the width over which the lifting needs to occur, e.g., when lifting is carried out by the two far sides.

Also, the supports for the lifting may be separated by varying widths.

SUMMARY

The present application describes a winch with movable end parts that allow it extend across variable length supports and to carry out lifting across those variable lengths.

DETAILED DESCRIPTION

According to an embodiment, a winch is described which can vary in width and hence can vary the locations of its outer extent.

Another embodiment describes special operations which enable a reduced-thickness winch. This can facilitate the use of this winch in certain applications, such as overhead and in limited space areas.

Figure 1A:
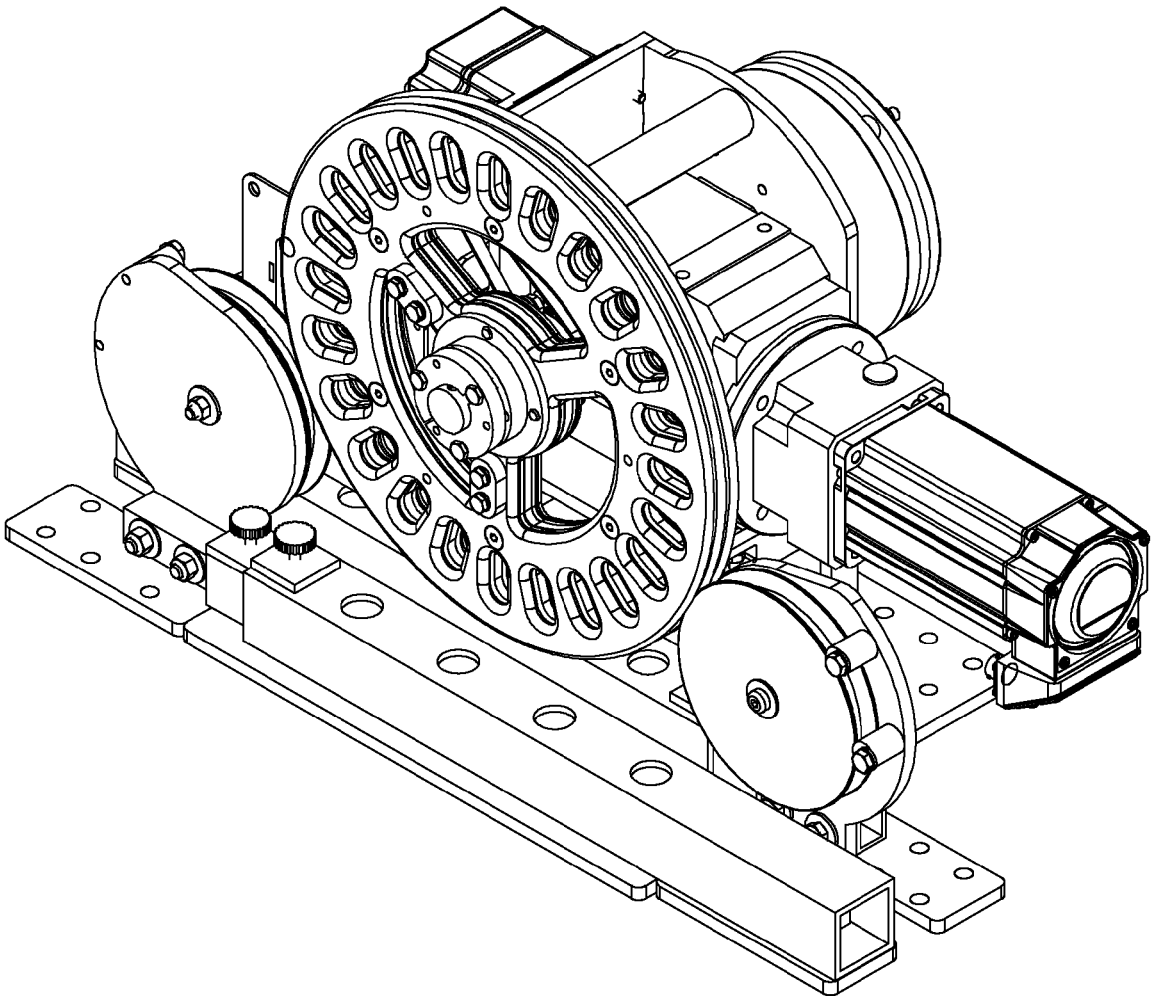
FIG. 1A-1C show the "tab" winch in multiple extended positions with different distances between the pulling areas.
Figure 1B:
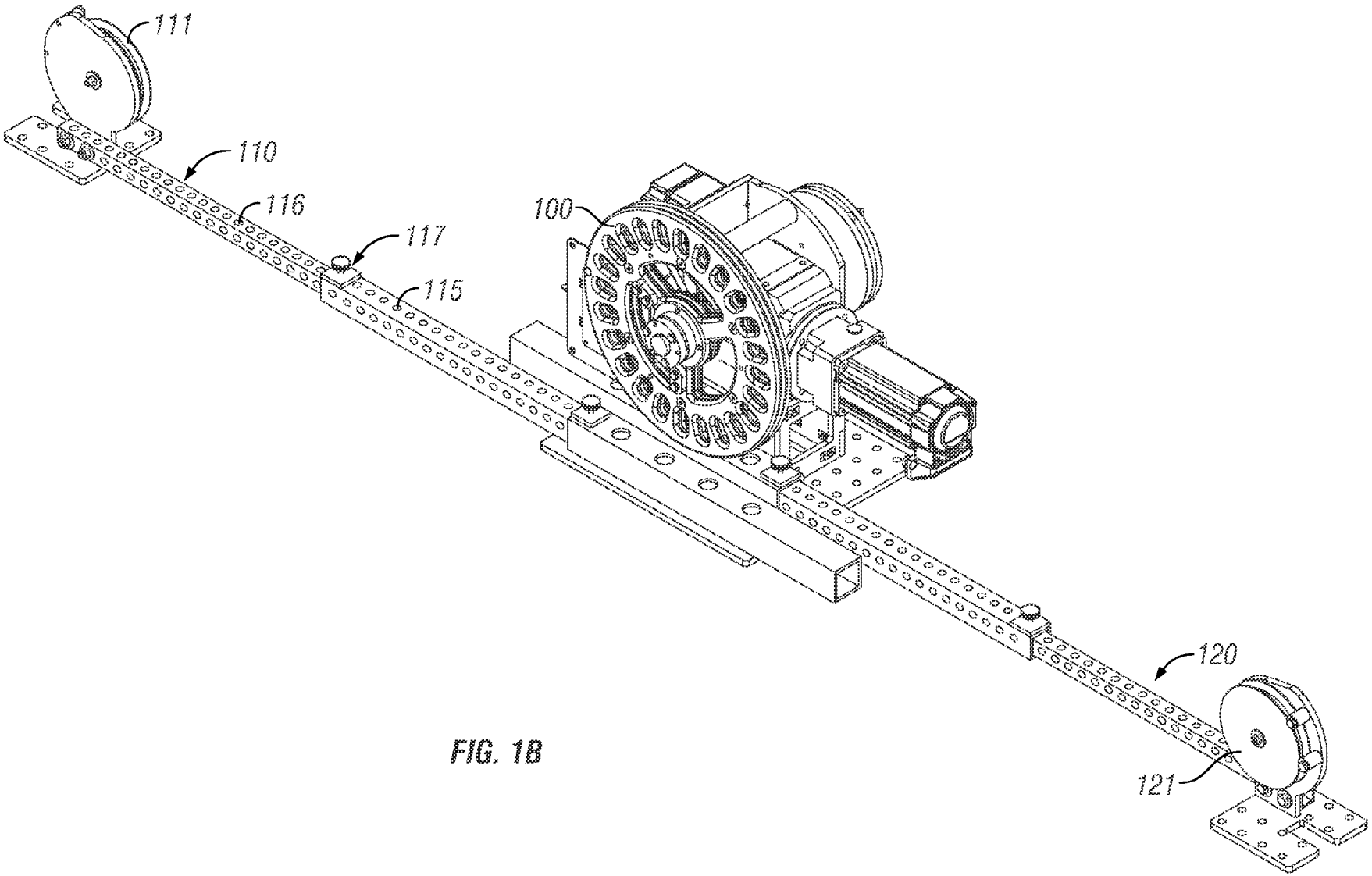
Figure 1C:
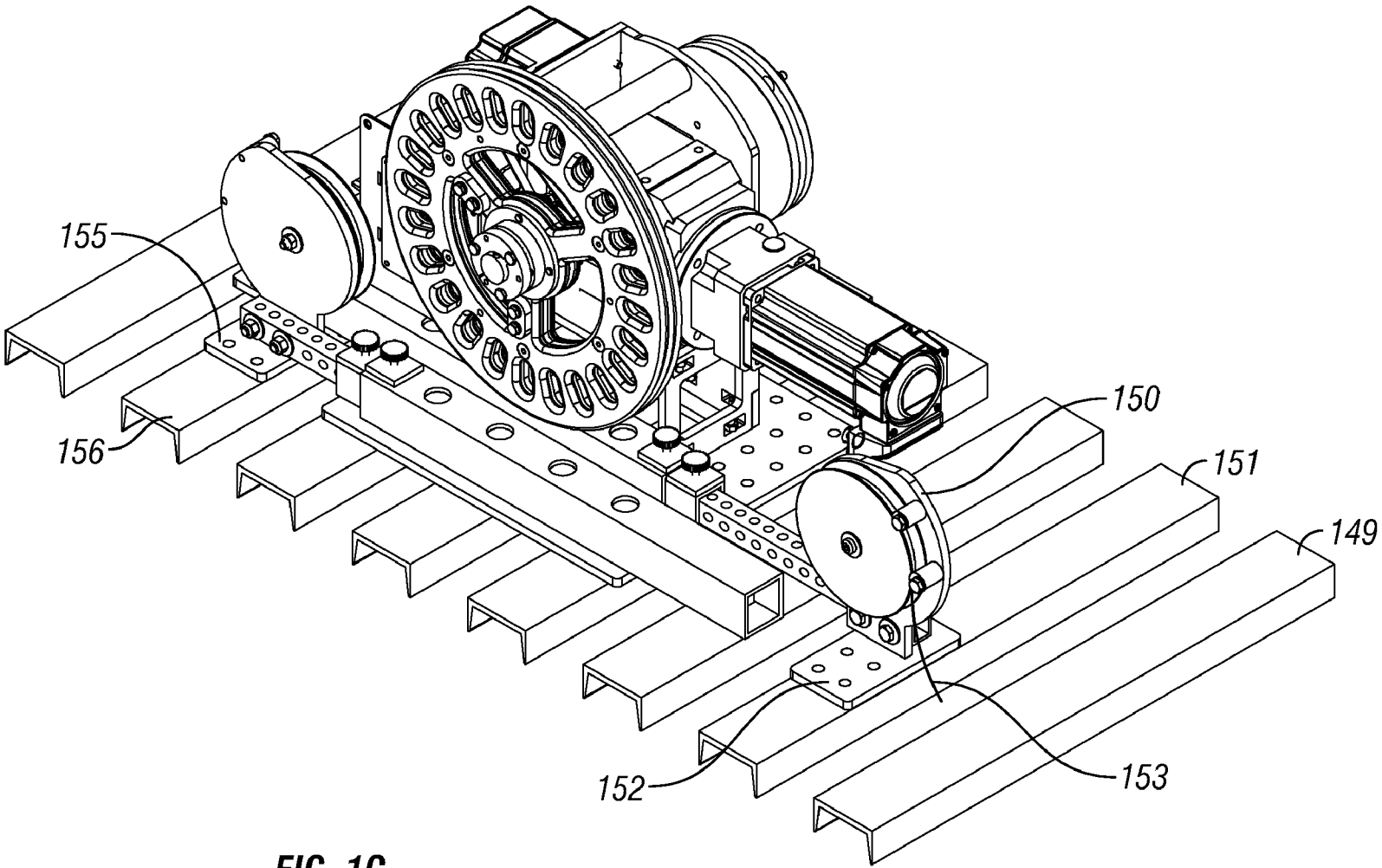

The basic diagram of the winch in multiple different configurations is shown in FIGS. 1A-1C.

The main part of the winch includes a special drum for unwinding cable from two different locations at the same time. The inventors call this a yoyo drum 100. The yoyo drum 100 has a power plant that causes its rotation. Two extendable arms 110, 120 are coupled to the yoyo drum 100 and can be extended relative thereto. Each arm 110, 120 has an idler at its very end. The arm 110 has the idler 111, and the arm 120 has the idler 121.

In operation, the cable pays onto and off of the drum 100 at two different locations simultaneously. One cable goes along arm 110 to idler 111, and is raised or lowered by the idler. The other cable goes along arm 120 to idler 121, and is simultaneously and synchronously raised or lowered from both spots.

Figure 2:
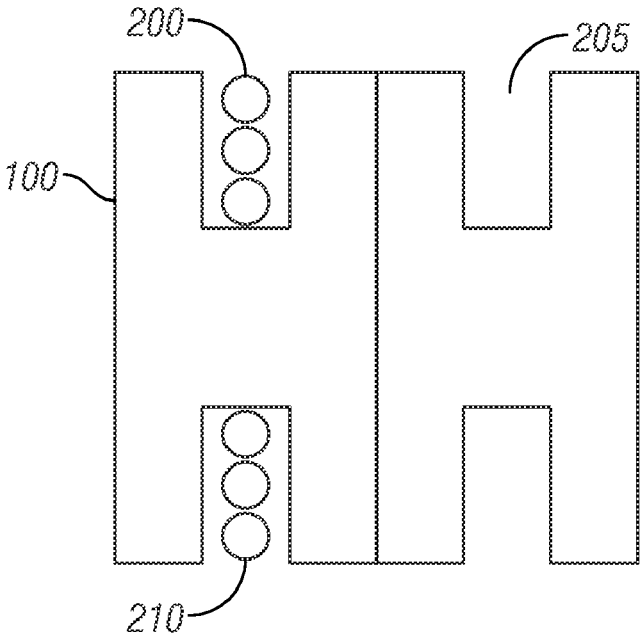
FIG. 2 illustrates a "tab" drum used according to an embodiment.

FIG. 2 shows a detail of the yoyo drum from its side, illustrating the two tabs in the drum and those tabs can each hold their own supply of cable. The yo-yo drum 100 includes two different tabs, 200, 205. Each tab forms a slot that holds a stack of cable such as 210. The cable can be stacked in each slot up from one side of the driven element, while simultaneously fed or taken up on the other tab from the driven element.

The special design allows the yoyo drum to hold cable only within a "tab" in the drum, and hence allows the drum to be very thin, even though it is a double cable supply drum. In the embodiment, the drum can be about the same thickness as the arms that extend and retract, so that the drum can fit within whatever thickness the arms can fit in. In one embodiment the drum is no thicker than the arms. In another embodiment, the drum is no more than 1.5 times the thickness of the arm.

The embodiment enables reconfiguring between multiple different crossbar sizes. For example, the crossbar elements such as 110 includes two portions 115, 116, which slide relative to one another. The portion 116 is smaller in outer cross section than the portion 115, and hence the portion 116 fits within the portion 115. Fasteners such as screws and nuts 117 hold the portion 115 relative to the portion 116.

Other ways of holding the two arm parts together can also be used. For example, a clamp system could be used to hold the parts relative to each other. A threaded system could be used where one rod is threaded within the other.

Thus the lengths of the arms can each be independently adjusted to any desired length. Hence, this winch can be reconfigured between any desired set of crossbar lengths.

Figure 3:
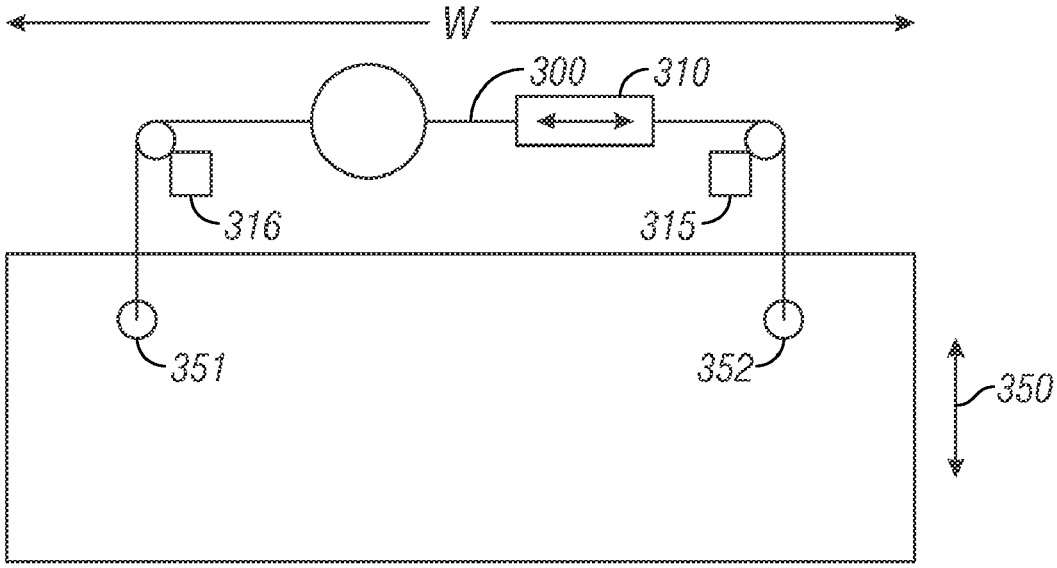
FIG. 3 illustrates the way that variable width lifting.

FIG. 3 illustrates how the distance 310 between the arms 315, 316 can be reconfigured. The distance W is based on the distance between holding portions 351, 352 on the item to be lifted 350. The movement of the winch cable causes the item 350 to go up and down.

Although only a few embodiments have been disclosed in detail above, other embodiments are possible and the inventors intend these to be encompassed within this specification. The specification describes specific examples to accomplish a more general goal that may be accomplished in another way. This disclosure is intended to be exemplary, and the claims are intended to cover any modification or alternative which might be predictable to a person having ordinary skill in the art. For example, other sizes, materials and connections can be used. Other structures can be used to receive the magnetic field. In general, an electric field can be used in place of the magnetic field, as the primary coupling mechanism. Other kinds of antennas can be used. Also, the inventors intend that only those claims which use the-words "means for" are intended to be interpreted under 35 USC 112, sixth paragraph. Moreover, no limitations from the specification are intended to be read into any claims, unless those limitations are expressly included in the claims.

Where a specific numerical value is mentioned herein, it should be considered that the value may be increased or decreased by 20%, while still staying within the teachings of the present application, unless some different range is specifically mentioned. Where a specified logical sense is used, the opposite logical sense is also intended to be encompassed.

What is claimed is:

1. A winch device comprising:

a cable drum that releases and wraps first and second different supplies of cable simultaneously;

a first support arm with an idler end, said first support arm coupled relative to said cable drum, and said first support arm adjustable to adjust a distance between said cable drum and said idler end, and said first idler end receiving said first supply of cable; and a second support arm, with a second idler end coupled to said second support arm, said second idler end receiving said second supply of cable, wherein said first support arm includes a first support part having a first inner size, and a second support part having a second outer size that fits within and slides within said first support part.

2. A winch device as in claim 1, wherein said second support arm adjustable to adjust a distance between said cable drum and said second idler end.

3. A winch device as in claim 1, wherein said first and second support arms are held one relative to another in a first mode, and allowed to move in a second mode.

4. A winch as in claim 1, wherein said drum has two slots therein, each holding a separate supply of cable, and where said two slots rotate in sync with one another to wind and unwind said cable in sync.

5. A winch as in claim 4, wherein said slots each hold only a single stack of cable.

6. A winch as in claim 5, wherein said drum is no thicker than either one of said first and second support arms.

7. A winch as in claim 5, wherein said drum is no more than 1.5 times thicker than either one of said first and second support arms.

8. A winch device comprising:

a cable drum that releases and wraps first and second different supplies of cable simultaneously, said cable drum having a first maximum thickness;

a first support arm with an idler end, said first support arm coupled relative to said cable drum and receiving said first supply of cable from said cable drum; and a second support arm, with a second idler end coupled to said second support arm, said second idler end receiving said second supply of cable from said cable drum, said cable drum having a second maximum thickness, and wherein said first maximum thickness is no greater than said second maximum thickness, said second support arm adjustable to adjust a distance between said cable drum and said second idler end, wherein said first support arm includes a first support part having a first inner size, and a second support part having a second outer size that fits within and slides within said first support part.

9. A device as in claim 8, wherein said first support arm adjustable to adjust a distance between said cable drum and said first idler end.

10. A winch device as in claim 8, wherein said second support arm adjustable to adjust a distance between said cable drum and said second idler end.

11. A winch device as in claim 8, wherein said first and second support arms are held one relative to another in a first mode, and allowed to move relative to one another in a second mode.

12. A winch as in claim 8, wherein said drum has two slots therein, each holding a separate supply of cable, and where said two slots rotate in sync with one another to wind and unwind said cable in sync.

13. A winch as in claim 12, wherein said slots each hold only a single stack of cable.

* * * * *